US005226464A

United States Patent [19]

Solov

[11] Patent Number: 5,226,464

[45] Date of Patent: Jul. 13, 1993

[54] PROTECTIVE GOLF BAG COVER

[76] Inventor: Paul Solov, 1796 Duffield La., Alexandria, Va. 22307

[21] Appl. No.: 925,246

[22] Filed: Jul. 31, 1992

[51] Int. Cl.[5] ..... A63B 55/00; A63B 57/00

[52] U.S. Cl. ..... 150/159; 206/315.4

[58] Field of Search ..... 150/159, 160; 206/315.3, 315.4

[56] References Cited

U.S. PATENT DOCUMENTS

| | | | |
|---|---|---|---|
| D. 256,293 | 8/1980 | Edwards | 206/315.4 X |
| 1,119,508 | 12/1914 | Headley | 206/315.6 |
| 1,581,061 | 4/1926 | Johnston | 206/315.2 X |
| 1,788,478 | 1/1931 | Beaty et al. | 206/315.6 |
| 2,471,169 | 5/1949 | Salzberg et al. | 150/159 X |
| 2,509,195 | 5/1950 | Barron | 206/315.6 X |
| 2,520,226 | 8/1950 | Smith | 206/315.4 X |
| 2,704,563 | 3/1955 | Henrich | 150/159 |
| 2,973,794 | 3/1961 | Erickson | 150/159 |
| 3,059,681 | 10/1962 | Lorbeski | 150/159 |
| 3,620,276 | 11/1971 | Taylor | 150/159 |
| 3,861,434 | 1/1975 | Harding | 150/160 |
| 3,913,648 | 10/1978 | Sessler | 150/159 X |
| 3,977,451 | 8/1976 | Duba | 150/159 X |
| 4,115,946 | 9/1978 | Vukmirovich | 446/46 X |
| 4,200,133 | 4/1980 | Whitlow | 150/159 |
| 4,453,632 | 6/1984 | Clower | 150/160 X |
| 4,498,579 | 2/1985 | Brick | 150/159 X |
| 4,522,300 | 6/1985 | Hamblet | 206/315.4 |
| 4,699,164 | 10/1987 | Pilney et al. | 150/160 X |
| 4,953,697 | 9/1990 | Stanley | 150/159 X |
| 5,024,259 | 6/1991 | Treadway | 150/159 |

FOREIGN PATENT DOCUMENTS

| | | | |
|---|---|---|---|
| 2452 | of 1911 | United Kingdom | 206/315.3 |
| 6126 | of 1911 | United Kingdom | 206/315.3 |
| 179067 | 5/1922 | United Kingdom | 206/315.3 |
| 275872 | 8/1927 | United Kingdom | 206/315.3 |
| 323902 | 1/1930 | United Kingdom | 206/315.3 |
| 365226 | 1/1932 | United Kingdom | 206/315.3 |
| 1230580 | 5/1971 | United Kingdom | 206/315.3 |
| 2103938 | 3/1983 | United Kingdom | 206/315.4 |

*Primary Examiner*—Sue A. Weaver
*Attorney, Agent, or Firm*—H. Jay Spiegel

[57] ABSTRACT

A protective golf bag cover is generally circular in configuration and is designed to be draped over golf clubs extending upwardly from the interior chamber of a golf bag. The inventive cover has an outer periphery which is weighted and has the further provision of an additional generally circular area between the center of the cover and the periphery which is also weighted so that the inventive cover may be draped over the upstanding clubs and will be retained in position without the need for any fasteners.

10 Claims, 2 Drawing Sheets

PROTECTIVE GOLF BAG COVER

BACKGROUND OF THE INVENTION

The present invention relates to a protective golf bag cover. In the prior art, golf bag covers are known. However, Applicant is unaware of any such device including all of the features and aspects of the present invention.

The present invention constitutes an improvement over the teachings of U.S Pat. No. 4,699,164 to Pilney et al. In the Pilney et al. device, the periphery of the octagonally shaped cover has an elongated flexible chain embedded therein providing a peripheral weight. At the center of the Pilney et al. cover, a fastener is provided which is designed to be fastened to one of the golf clubs to fasten the Pilney et al. cover in mounted position. Thus, Pilney et al. show embodiments have a sock-like fastener, a snap-type fastener and a hook and pile fastening means. The use of fastening means with the cover of Pilney et al. provides a significant limitation. Thus, in order to fasten the Pilney et al. device in mounted position, one must utilize one of the clubs in the golf bag as a point of attachment, either directly or through the use of a snap or hook and pile fastening means. When one is utilizing the Pilney et al. cover, and one desires to use the club which is being used to fasten the cover in place, one must remove the fastener from the club thereby imperiling the continuing retention of the Pilney et al. cover in mounted position. In contrast to this, in accordance with the teachings of the present invention, a circular weighted portion is provided in the present invention between the center of the cover and the periphery thereof which weighted portion fits over the ends of the golf clubs thereby holding the inventive cover in place without the need for fastening the cover to any particular club. Thus, in accordance with the teachings of the present invention, any club may be chosen from the golf bag without imperiling the retention of the inventive device in position draped over the clubs and the bag opening.

Over and above the Pilney et al. teachings, the following prior art is known to Applicant. Some of these references are cited as prior art on the face of the Pilney et al. patent. Some of the references cited on the face of the Pilney et al. patent have no relevance concerning the teachings of the present invention since they are directed to fastening means not contemplated herein. As such, only those references cited on the face of the Pilney et al. patent which are deemed at least generally related to the teachings of the present invention are discussed herein. Other references uncovered by Applicant are also discussed. The prior art known by Applicant and believed to be at least generally of interest concerning the teachings of the present invention is as follows:

| | |
|---|---|
| Des. 256,293 to Edwards | 3,977,451 to Duba |
| 1,562,030 to Lawrence | 4,115,946 to Vukmirovich |
| 2,471,169 to Salzberg et al. | 4,200,133 to Whitlow |
| 2,520,226 to Smith | 4,453,632 to Clower |
| 2,704,563 to Henrich | 4,498,579 to Brick |
| 2,973,794 to Erickson | 4,522,300 to Hamblet |
| 3,059,681 to Lorbeski | 4,953,697 to Stanley |
| 3,620,276 to Taylor | 5,024,259 to Treadway |
| 3,913,648 to Sessler | UK Patent 2107594 A to Andrews |

Edwards teaches a rain cover for a golf bag having a slit allowing a portion of the cover to be folded back to expose golf clubs. The present invention contemplates no such slit.

Lawrence teaches a cap or hood b preferably made of canvas and having a flexible but inextensible band at its periphery. The present invention differs from the teachings of Lawrence as providing two weighted areas, one at the periphery of the cover and the other one midway between the periphery and the center thereof.

Salzberg et al. teach a golf bag having a cover which is fastened to the golf bag. The present invention differs from the teachings of Salzberg et al. as contemplating a cover which is draped over the clubs and bag opening without the use of any fastening means.

Smith teaches a combined golf bag and caddy cart including a hood "for protecting the heads of the clubs when they are inserted in the bag". A metal hoop is provided to surround the mouth of the hood to give shape and definition to the bag. The present invention differs from the teachings of Smith as contemplating a cover weighted in two regions and designed to be draped over the clubs and opening of a golf bag.

Henrich discloses a golf bag cover fastened to the golf bag through the use of a strap. The Henrich cover has an elastic periphery allowing it to be stretched over the golf bag opening. The present invention includes no elastic structure nor any strap and is more than adequately held in its desired position.

Erickson teaches a golf cart hood having a rigid rim portion. The present invention differs from the teachings of Erickson as having a flexible weighted rim as well as a second weighted area.

Lorbeski teaches a golf bag cover having a connector designed to allow it to be secured. The present invention differs from the teachings of Lorbeski as teaching a cover which may be draped over upwardly extending golf clubs and including two weighted areas to hold the inventive cover in place.

Taylor teaches a cover having an opening allowing the handle of the golf cart to protrude therethrough. Taylor fails to teach or suggest the weighted structure of the present invention.

Sessler teaches a golf bag cover having weights at the periphery thereof as well as an additional tie string. Sessler fails to teach or suggest the secondary weighted region taught by Applicant herein.

Duba teaches a golf bag hood rain cover which utilizes hook and pile fastening means to fasten two halves of the cover together. The present invention differs from the teachings of Duba as providing a one piece construction having two weighted regions.

Vukmirovich discloses a flexible discus device which is generally related, in structure, to the teachings of the present invention as having a peripheral weighted portion. However, Vukmirovich fails to teach or suggest the second weighted region nor the environment of intended use of the present invention.

Whitlow teaches a golf bag cover which is tube-like so that it may be folded upon itself to protect golf clubs and the interior of the golf bag in which the clubs are contained. The upper opening of the Whitlow device has elastic to hold it in a restricted configuration. The present invention differs from the teachings of Whitlow as contemplating a protective golf bag cover which has no central opening and includes two weighted regions.

Clower teaches a protective cover for golf clubs including a plurality of weights about the periphery thereof as well as elongated guide members which are designed to prevent the cover from sliding sideways. The present invention differs from the teachings of Clower as teaching a circular weighted region between the center of the cover and the periphery thereof.

Brick teaches a cover for a golf bag having a peripheral elastic strip. The present invention differs from the teachings of Brick as contemplating two weighted regions.

Hamblet teaches a golf bag protector having a central support shaft supporting an umbrella-like cover. The present invention differs from the teachings of Hamblet as contemplating a weighted periphery as well as a second weighted region between the periphery and the center of the device.

Stanley teaches a self-retaining golf bag cover employing a plain sleeve. A drawstring allows closure of an upper opening thereof. The present invention differs from the teachings of Stanley as providing two weighted regions as well as providing a continuous structure with no central opening.

Treadway teaches a golf club rain sack designed to be mounted over golf clubs protruding from the opening of a golf bag. The Treadway device includes weights designed to maintain the hood in mounted position. The present invention differs from the teachings of Treadway as contemplating a continuous peripheral weight as well as a second continuous weighted region.

Andrews teaches a golf bag hood designed to be inflated into mounted position. The present invention differs from the teachings of Andrews as contemplating a golf bag cover having two weighted regions allowing it to be draped over golf clubs emanating from the opening of a golf bag.

SUMMARY OF THE INVENTION

The present invention relates to a protective golf bag cover. The present invention includes the following interrelated objects, aspects and features:

(A) In a first aspect, the inventive cover consists of a generally circular piece of fabric or canvas which may, if desired, be made of a plurality of panels of fabric or canvas stitched together at seams.

(B) At the periphery of the cover, a peripheral chamber is provided which encloses a flexible weight such as a heavy gauge wire, a chain, sand or other heavy material.

(C) Between the center of the cover and the periphery, a second weighted region is provided which consists of a circular chamber containing a weighted material such as a flexible chain, sand, a heavy wire, or the like.

(D) In using the present invention, golf clubs are placed within a golf bag with the clubs extending upwardly beyond the golf bag opening. The inventive cover is draped over the ends of the clubs with the periphery of the cover extending below the golf bag opening and with the peripheral weighted portion serving to hold the cover in the position as placed. The second weighted region located between the periphery and the center of the cover closely surrounds the shafts of the golf clubs and assists in holding the cover in its placed position.

As such, it is a first object of the present invention to provide a protective golf bag cover.

It is a further object of the present invention to provide such a cover having a peripheral weighted portion.

It is a still further object of the present invention to provide such a protective golf bag cover having a second weighted region between the center of the cover and the periphery thereof.

It is a yet further object of the present invention to provide such a cover which may be retained in place without the use of any fastening means fastening the cover to the golf bag.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
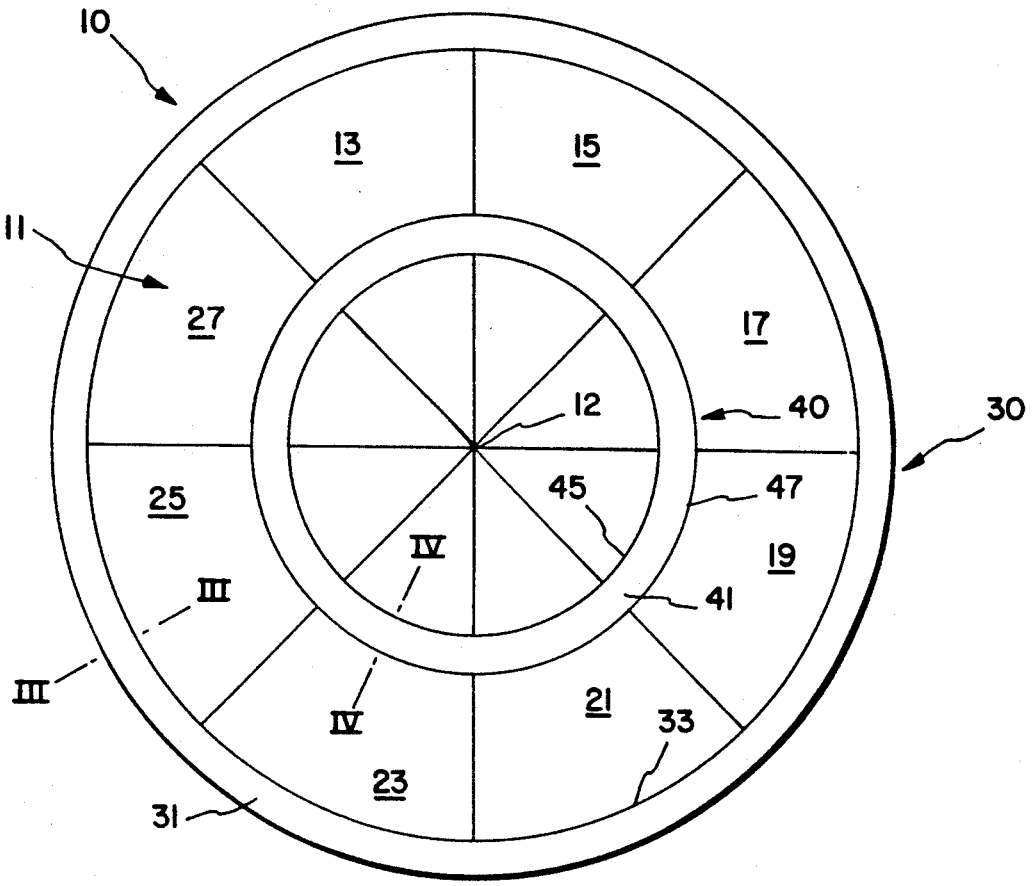
FIG. 1 shows a bottom view of the present invention.

With reference to FIG. 1, the inventive device is generally designated by the reference numeral 10 and is seen to include a generally circular body 11 made up of a plurality of panels 13, 15, 17, 19, 21, 23, 25 and 27, preferably stitched together at the seams as shown, in any suitable manner. Of course, if desired, the body 11 may be made of a single piece of fabric.

Figure 3:
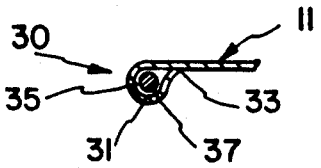
FIG. 3 shows a cross-sectional view along the line III—III of FIG. 1.

The body 11 has a periphery 30 which is best seen with reference to FIG. 3. As seen in FIG. 3, the periphery 30 of the body 11 includes a folded over portion 31 which is attached to the underside of the body 11 at 33 through any suitable means such as stitching, adhesive or the like. The folded over portion 31 forms a chamber 35 in which is contained a flexible weight 37.

The flexible weight 37 may comprise an elongated heavy wire, an elongated chain or, if desired, may comprise a substance such as sand which may be suitably installed within the chamber 35. In essence, the periphery 30 of the body 11 is weighted by the provision of the weight 37 so that the device 10 may be placed over a golf bag 1 (FIG. 5) with the weighted periphery 30 helping to hold the inventive device 10 in the position shown in FIG. 5.

Figure 2:
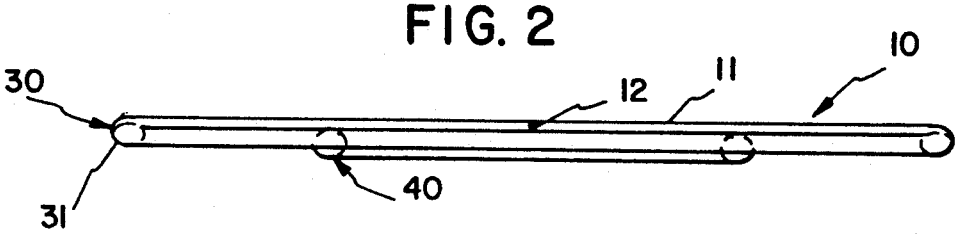
FIG. 2 shows a side view of the present invention.
Figure 4:
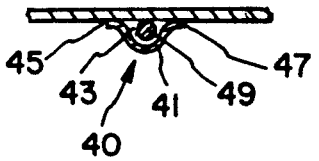
FIG. 4 shows a cross-sectional view along the line IV—IV of FIG. 1.

With reference back to FIGS. 1 and 2, between the center region 12 of the body 11 and the periphery 30, a further weighted region is provided and is generally designated by the reference numeral 40. As seen in FIG. 4, this further weighted region consists of a piece of fabric or other device 41 attached with a U-shaped cross-section onto the underside of the body 11 to form an internal chamber 43. As seen in FIG. 1, in particular, the fabric 41 has two concentric circular areas of attachment with the inner concentric area being designated by the reference numeral 45 and with the outer area being designated by the reference numeral 47. The further weighted region 40, as particularly shown in FIG. 1, surrounds the center region 12 and is surrounded by the periphery 30. The fabric 41 may be attached to the underside of the body 11 in any suitable manner such as through the use of adhesives, stitching, or any other suitable means. Alternatively, the chamber 43 can be formed by gathering the fabric of the body 11 to form a circular chamber and, with the weight 49 contained therein, stitching adjacent fabric regions together to close the circular chamber.

With particular reference to FIG. 4, it is seen that contained within the chamber 43 is a weight 49 which, as is the case with the weight 37, may comprise an elongated heavy wire, a chain or, if desired, a substance such as sand which may be contained within the chamber 43. Thus, in accordance with the teachings of the present invention, the device 10 is provided with a weighted periphery 30 as well as a second weighted region 40 between the center 12 of the body 11 and the periphery 30 thereof to form two weighted regions provided to facilitate retention of the device 10 in the configuration shown in FIG. 5.

Figure 5:
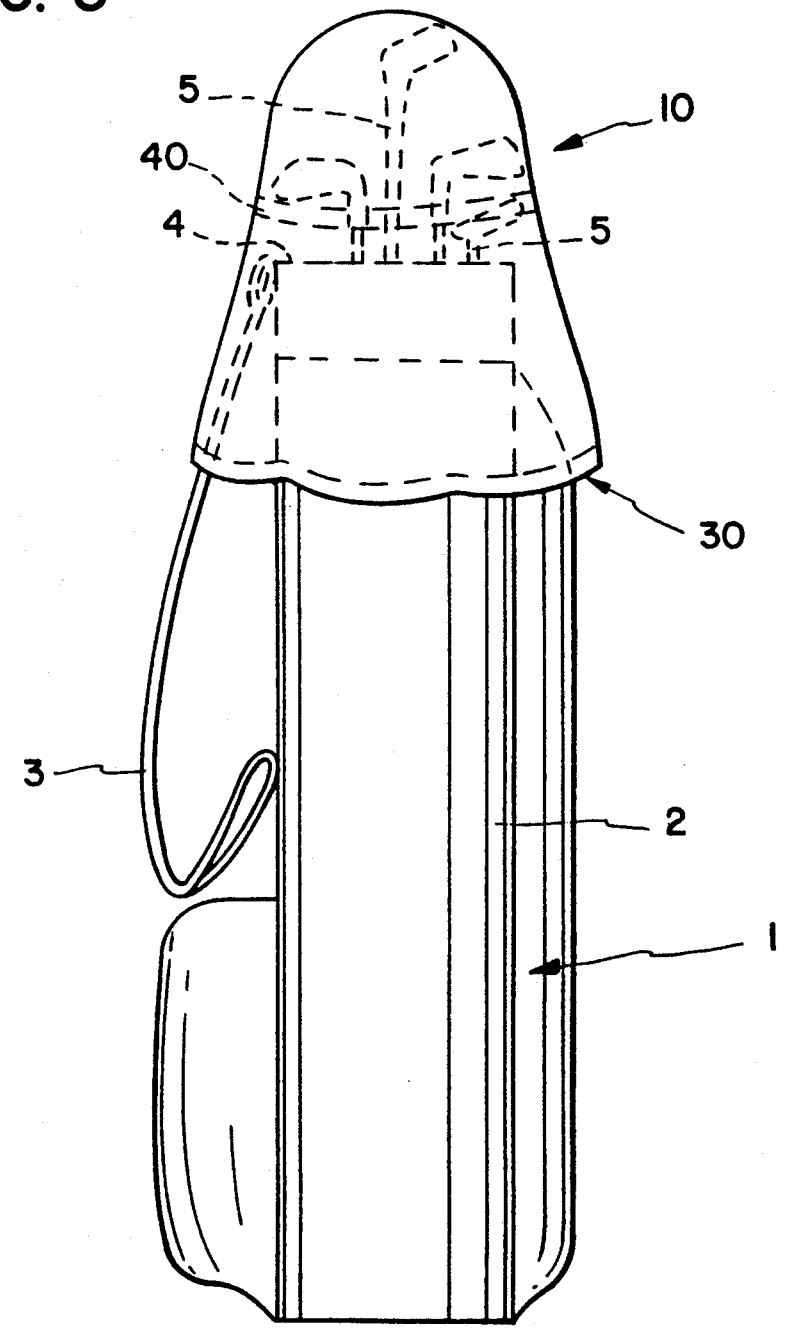
FIG. 5 shows a side view of a golf bag having the inventive cover placed thereover.

As shown in FIG. 5, the golf bag 1 has a body 2 as well as a strap 3 and has an upwardly facing opening 4 from which a multiplicity of clubs 5 emanate which are placed within the bag 1 and are contained therein. As seen in FIG. 5, the weighted periphery 30 extends slightly below the opening 4 in the bag 1 when draped thereover in the desired fashion. Furthermore, the weighted region 40 extends below the heads of the golf clubs and a slight distance down the shafts thereof in a manner causing the device 10 to assume the bell-like configuration shown in FIG. 5 with the upper portion closely surrounding the conglomeration of golf club shafts and with the device 10 billowing outwardly so that the periphery 30 surrounds the opening 4 in the bag 1.

In the configuration shown in FIG. 5, the weighted regions 30 and 40 of the cover 10 will act to hold the cover 10 in the position shown without the need for any fastening devices. Furthermore, when it is desired to remove one of the clubs 5 from the bag 1, there is no need to unfasten the cover 10 from any of the clubs 5. Rather, a portion of the periphery 30 of the cover 10 may be gripped and moved upwardly to expose the clubs, whereupon the desired club may be removed and the cover 10 may be replaced in the position shown in FIG. 5.

Since the rules of the United States Golfing Association limit the number of clubs which may be carried in a bag to a maximum of 14 clubs, through the use of the present invention, all 14 clubs may be inserted into the bag 1 and all of the clubs are immediately available for use without the need for unfastening of the cover 10 from any club. Thus, the present invention is advantageous over the prior art since it does not inhibit the golfer from using any clubs, requires no attaching devices to fasten the cover over the golf bag while providing excellent protection of the clubs from inclement weather at all times.

In the preferred embodiment of the present invention, the fabric or canvas material which is utilized in making the inventive device may be waterproof or otherwise fluid impervious.

As such, an invention has been disclosed in terms of a preferred embodiment thereof which fulfills each and every one of the objects of the invention and provides a new and useful protective golf bag cover of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A protective golf bag cover, comprising:

a) a flexible thin body having a periphery, a center region and a further region surrounding said center region and surrounded by said periphery, said further region being entirely spaced from said periphery and said center region;

b) said periphery including a first weighted structure including weighted portions extending about said periphery; and c) said further region entirely containing a second weighted structure having further weighted portions extending substantially uniformly about said further region;

d) whereby said cover may be draped over one or more golf clubs extending outwardly from a golf bag and is retained thereover solely through force of gravity acting upon said body and said first and second weighted structures.

2. The invention of claim 1, wherein said first weighted structure comprises a continuous flexible elongated weight extending substantially completely about said periphery.

3. The invention of claim 2, wherein said weight is endless.

4. The invention of claim 2, wherein said second weighted structure comprises a continuous flexible elongated further weight.

5. The invention of claim 1, wherein said second weighted structure comprises a continuous flexible elongated weight.

6. The invention of claim 5, wherein said weight is endless.

7. The invention of claim 6, wherein said weight is generally circular in configuration.

8. The invention of claim 1, wherein said body is made of fabric.

9. The invention of claim 8, wherein said body is made of a plurality of fabric panels fastened together.

10. The invention of claim 8, wherein said fabric is waterproof.

* * * * *